US005299555A

United States Patent [19]

Claes

[11] Patent Number: 5,299,555

[45] Date of Patent: Apr. 5, 1994

[54] FRAME ELEMENT FOR FORMING A GRATE

[75] Inventor: Jean-Claude Claes, Olne, Belgium

[73] Assignee: Abrasion Engineering Company Limited, Channel Islands, United Kingdom

[21] Appl. No.: 940,940

[22] Filed: Sep. 8, 1992

[30] Foreign Application Priority Data

Sep. 9, 1991 [BE] Belgium ..... 91115207.2

[51] Int. Cl.[5] ..... F23H 13/00

[52] U.S. Cl. ..... 126/152 B; 110/291; 126/152 R

[58] Field of Search ..... 110/291, 298, 299, 281, 110/282, 283; 126/152 R, 152 B, 174, 175

[56] References Cited

U.S. PATENT DOCUMENTS

| | | | |
|---|---|---|---|
| 4,450,952 | 5/1984 | Steiner | 126/175 X |
| 4,563,959 | 1/1986 | Fujiwara | 110/281 |
| 4,671,190 | 6/1987 | Moreau | 110/281 |
| 4,870,913 | 10/1989 | Schneider | 110/291 X |

FOREIGN PATENT DOCUMENTS

| | | |
|---|---|---|
| 0167658 | 1/1986 | European Pat. Off. . |
| 0464509 | 11/1913 | France . |
| 1566382 | 4/1980 | United Kingdom . |
| 2059050 | 4/1981 | United Kingdom . |

*Primary Examiner*—Edward G. Favors

*Attorney, Agent, or Firm*—Flynn, Thiel, Boutell & Tanis

[57] ABSTRACT

A frame element (8) for forming a grate, including two spaced-apart side members (12,14) and several plate members (6) arranged one next to the other between the side members in longitudinal direction thereof, between which plate members is provided a gas-venting slot (34). The side members (12,14) are formed by two opposing surfaces of a rigid frame (2), and the plate members (6) are each constructed as individual structural parts releasably connectable to the side members (12,14). The plate members (6) are preferably inserted one after the other into longitudinally extending guideways (18,20) arranged on the frame and are spaced apart by spacing projections (30,32), the spacing being necessary to form a gas-venting slot (34).

13 Claims, 2 Drawing Sheets

FRAME ELEMENT FOR FORMING A GRATE

FIELD OF THE INVENTION

The present invention relates to a frame element for forming a grate which is used for example to support solid materials during their burning, cooling or other heat treatment. Slots provided between plate members are used to blow out a gas, for example air, which flows from the bottom to the top through the material supported on the grate. The gas can fulfill different tasks in a conventional manner, namely for example a cooling of the grate, a cooling or heat treatment of the materials supported on the grate, a moving of this material, and the like.

BACKGROUND OF THE INVENTION

Such grates are generally exposed to great wear. This is particularly true for their use during cooling of cement clinkers, which with great weight also have a coarse surface roughness.

A frame element of the type mentioned in the Oberbegriff of claim 1 is already known from EP-0 167 658 B1. This frame element consists of two basic structural parts, of which each has a side member and several plate members connected in one piece at twice the distance of the provided plate member distance to same; the frame element is mounted by connecting two side members with one another in such a manner that the plate members on one side member grip between the plate members on the other side area and are placed into receiving openings constructed on said side area. In order to hold together the frame element formed of the basic structural parts, the basic structural parts are, for example, additionally bolted together on the underside of the frame element.

A disadvantage of the known construction is that when individual plate members and/or side members wear excessively, the entire frame element or at least complete basic structural parts must be replaced, in the latter case with the connection holding together the structural parts having to be disconnected in a complicated manner and having to again be connected after a basic structural part has been replaced. In general still usable, nonworn parts of the frame element are thereby also replaced, which results in high material replacement costs; on the other hand, the disassembling and assembling operations are time-consuming, which results regularly in longer down times for the entire system. This problem is made still more difficult since several frame elements are connected with one another to form a grate and this grate is in turn fastened on a grate carrier so that, for example, the necessity of replacing individual plate members always has the result that also the walls connected thereto must be exchanged and that also their connection to the frame elements adjacent to the walls and to the grate carrier must be disconnected and again connected after the exchange.

SUMMARY OF THE INVENTION

The purpose of the invention is to provide a frame element in which a replacement of individual, worn parts is possible with little disassembly or assembly work and by saving material.

The basic idea of the present invention is to divide the frame element differently than up to now into a frame component providing two connected side members and individual plate members connectable to the frame. With this the problem is addressed that primarily the plate members are exposed to increased wear and must be exchanged. The construction embodying the invention makes it possible to replace individual plate members with little disassembly or assembly work and without having to exchange at the same time also the still intact side members. The connection of the plate members with the side members is structurally very easily accomplished, as will be described in greater detail in connection with several exemplary embodiments.

A further advantage is that the two side members of a frame element are no longer bolted together in the described manner and must be connected with one another in a different manner.

The division of the frame element carried out according to the present invention follows thus the different functions of the side members on the one hand, which preferably serve as mounting elements for the plate members, and of these plate members on the other hand, which preferably form the grate surface and thus are subjected to more wear. This division makes it, for example, also possible to make the frame, on the one hand, and the plate members, on the other hand, of different materials adapted at an optimum to their respective functions.

A preferred embodiment of the invention provides that each of the side members has a longitudinal guide profile thereon extending in a longitudinal direction thereof and serving as a guide rail, and that the plate members have at their lateral edges a conforming counter profile cooperating with the respectively associated longitudinal guide profile. This design enables a particularly simple mounting of the plate members by laying these simply one next to the other onto the longitudinal guide profiles on the side members.

The longitudinal guide profiles can be constructed as grooves and the conforming counter profiles accordingly as tongue-like flanges or vice versa, as is illustrated by the different exemplary embodiments.

The side members are, in a preferred development of the invention, formed by sidewalls which are parallel to one another and are oriented perpendicularly relative to the frame plane, with the sidewalls being connected with one another at least on a front end by a front wall having an upper edge which is lower compared with an upper edge of the sidewalls; the longitudinal guide profiles are then provided on the inner surfaces of the sidewalls above said upper edge of the front wall, which inner surfaces face one another, so that they terminate at the front end in the front facing edges of the sidewalls. This construction makes it possible to line up the plate members from the front end perpendicularly between the sidewalls so that the entire frame element represents a compact, outwardly smooth structural part, which can be connected in a simple manner gas tight with other frame elements to form one grate.

The front end is thereby preferably the leading end in conveying direction, which corresponds with the area of the frame element which is exposed the most to wear so that the plate members to be exchanged are also the first ones to be accessible.

In order to fix the position of the plate members in longitudinal direction of the sidewalls or with respect to adjacent plate members, the invention provides further more that the plate members have spacing projections designated for abutment against an adjacent plate member; they make it possible to insert each of the plate members up to the stop one next to the other into the longitudinal guide profiles, with these spacing projections defining also a gas-outlet slot between the plate members.

A further important improvement in the sense of the above-described division of the frame, on the one hand, and of the plate members, on the other hand, is achieved such that the plate members have on each of their lateral edges a longitudinal flange designed to cover the upper edge of an associated side member. The longitudinal flanges rest, during insertion of the plate members into the longitudinal guide profiles, on the upper edge of the associated side member to cover the upper edge of the side member. The side members are in this manner effectively protected against a wear by the material lying on the grate so that an exchange of the frames is no longer at all necessary.

By constructing the plate members such that they each have a main section forming the grate surface and a shoulder extending beneath an adjacent plate member, it is provided that the conforming counter profiles designated for engagement with the longitudinal guide profiles and the longitudinal flanges designated for covering the upper edges of the side members are provided only on the lateral edges of the main section.

In order to fasten the plate members with respect to the frame, a particularly simple solution is the provision of an end plate member equipped with means for facilitating a locking connection to the frame. This end plate member is introduced as the last plate member into the longitudinal guide profile and is connected in any suitable manner to the frame so that it holds the other plate members. The end plate members can be secured, for example, by welding, by bolting, by locking or in any other known manner.

A preferred use of the frame elements of the invention are so-called step grates. The frame has in this case in its end region associated with the front end a bottom wall and in its end region remote from the front end a top wall, with each frame element resting with the bottom wall on a top wall of a next adjacent frame element in a conveying direction of the material placed thereon. The front end of all frame elements remains in this manner, also in the mounted state, always easily accessible so that an exchange of individual plate members is possible without disassembling the associated frame.

Further details, advantages and characteristics result from the following description and the drawings, which are expressly pointed out regarding the disclosure of all details not described in the text.

BRIEF DESCRIPTION OF THE DRAWINGS

Exemplary embodiments of the invention are illustrated in the drawings and will be described in greater detail hereinafter. In the drawings.

DETAILED DESCRIPTION

Figure 1:
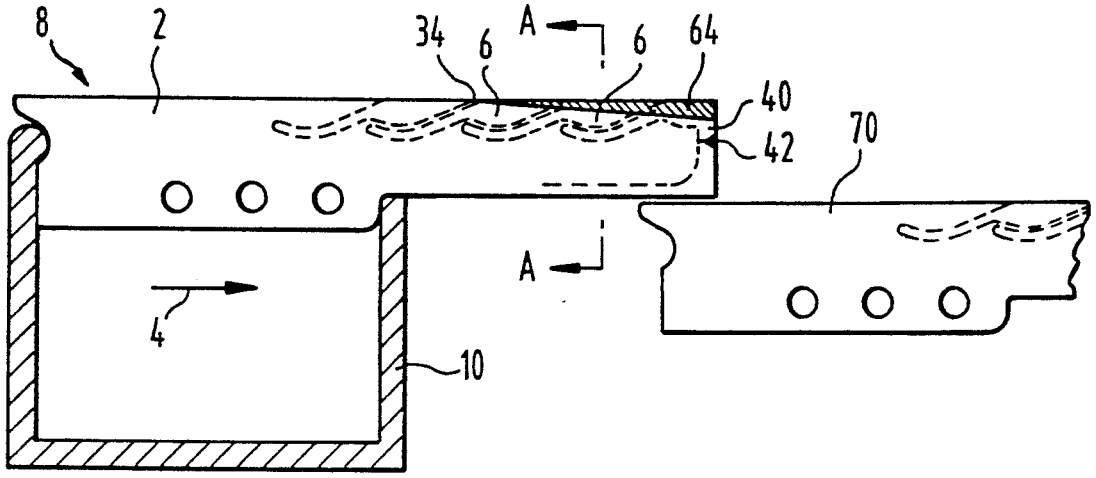
FIG. 1 is a side view of a frame element supported on a grate carrier and of a further frame element cooperating like a step grate with the frame element.

With respect to the following description of examples, reference is also made to EP-0 167 658 B1, which is mentioned in the above introduction to the description. This reference shows in FIG. 8 details of the basic design of a grate with the help of frame elements. Several frame elements, which are connected with one another and which are arranged side-by-side with reference to the conveying direction, result in a row of grates; several rows of grates arranged one behind the other in conveying direction make up the grate. The frame elements lying and next to the other in conveying direction can thereby be arranged steplike as indicated in the present FIG. 1.

The frame element 8, which is preferably formed of a one-piece frame 2 and a plurality of plate members 6 arranged one next to the other in the conveying direction identified by the arrow 4, is supported on a grate carrier 10. The grate carrier 10 is connected to a gas-supply line in a manner not illustrated. As can be seen particularly in FIG. 3, the frame 2 includes two side members 12,14 designed as upstanding sidewalls oriented perpendicularly to the main plane of the frame. The sidewalls 12,14 are connected at their front ends 15, which is a leading end in conveying direction, by a front wall 16, an upper edge of which is lower compared with the upper edge of the sidewalls 12,14 so that the upper edges of the sidewalls 12,14 project upwardly beyond the upper edge of the front wall 16.

Figure 2:
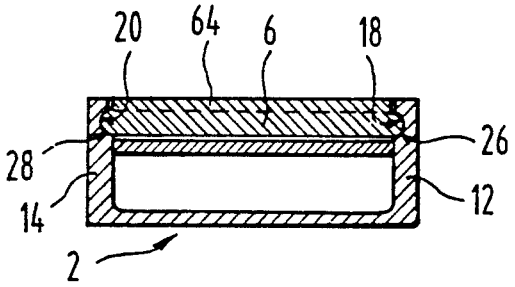
FIG. 2 is a cross-sectional view of the frame element of FIG. 1 taken along the cross-sectional line A—A.
Figure 3:
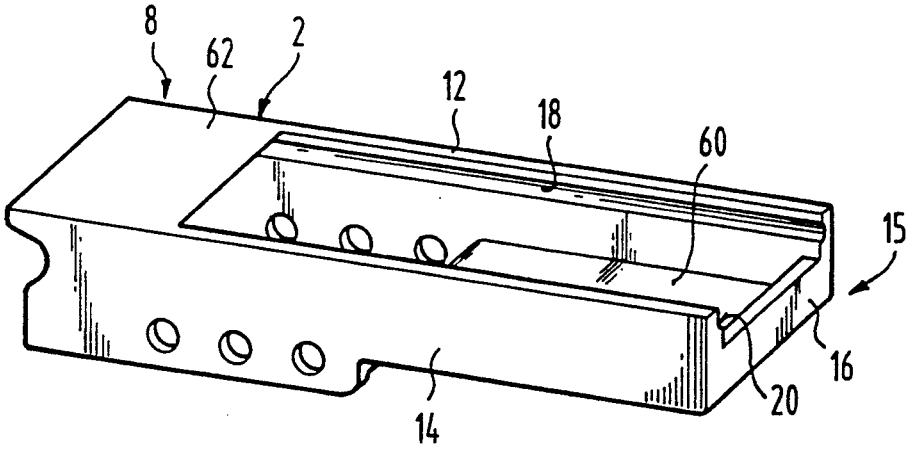
FIG. 3 is a perspective illustration of a frame of the frame element illustrated in FIG. 1.

FIGS. 2 and 3 show that longitudinally extending grooves 18,20 are provided on the opposing inner surfaces of the sidewalls 12,14. The longitudinally extending grooves serve as longitudinally extending guide profiles for supporting the plate members 6, are arranged at a level above the level of the upper edge of the front wall 16 and open outwardly in the region of the front end of the frame so that the grooves are accessible from the front facing end.

Figure 4:
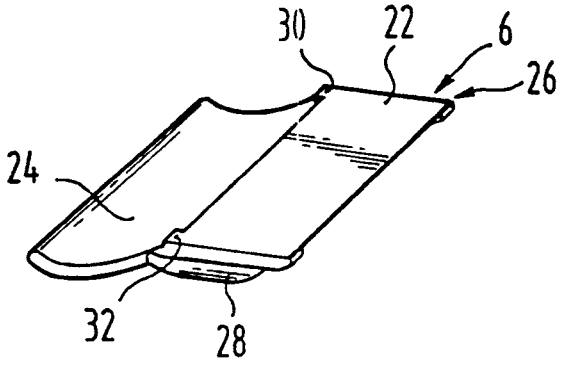
FIG. 4 is a perspective illustration of a plate member.
Figure 5:
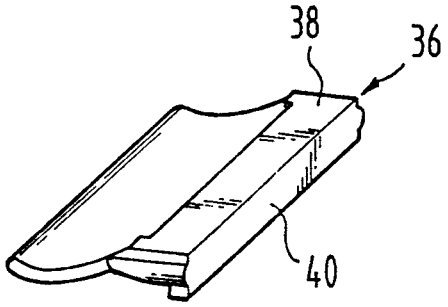
FIG. 5 is a perspective illustration of an end plate member.

FIG. 4 shows a plate member 6. The plate member consists essentially of a main section 22 forming a grate surface and a shoulder 24 arranged on the main section, which shoulder extends, in the manner illustrated in FIG. 1, beneath a main section of an adjacent plate member. Tongue-like flanges 26,28 are provided on the lateral edges of the main section 22, which tongue-like flanges are formed to conform complementarily with respect to the longitudinally extending grooves 18,20. The plate members 6 are inserted one after the other into the longitudinally extending grooves 18,20 from the front end 15 of the frame.

Two spacing projections 30,32 are provided on the edges of the main section 22 facing away from the front end, which spacing projections engage the opposite edges of the main section 22 of the respectively earlier inserted plate member 6. These spacing projections serve to define a gas-venting slot 34 between the mutually adjacent plate members 6 (see FIG. 1). The spacing projections can easily be reduced in size by a metal shaving process or can be increased in size by building the area up through welding so that the width of the slot can be varied.

In order to secure the plate members 6 in the frame, an end plate member 36 is inserted last. The end plate member 36 differs from a regular plate member 6 in that the main section 38 thereof has at its end, which is the trailing end relative to the insertion direction, a downwardly extending end flange 40 extending essentially to the upper edge of the front wall 16. Means for facilitating a locking of the end plate member 36 to the frame 2 are provided on the end flange 40, on the one hand, and on the front wall 16, on the other hand. At least one of the two adjacent edges of the end flange 40 or of the front wall 16 has preferably, in the illustrated exemplary embodiment, a bevel enabling in a simple manner the creation of a connecting welding seam 42.

Figure 6:
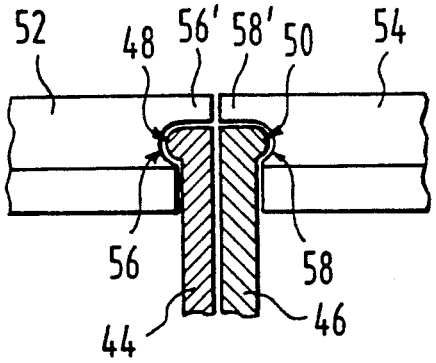
FIG. 6 is a cross-sectional view of a detail of two adjacent frame elements.

FIG. 6 shows a detail of another exemplary embodiment of the longitudinal guide for the plate members in the frame. FIG. 6 shows two adjacent sidewalls 44,46 of two frame elements arranged side-by-side in a row of grates. The sidewalls 44,46 have at their respective upper ends a tongue-like flange 48,50 serving as a longitudinally extending guide profile, while the conforming profiles arranged on the plate members 52,54 are constructed as grooves 56,58 conforming complimentarily with respect to the tongue-like flanges.

FIG. 6 shows further more that the plate members 52,54 have on each of their lateral edges a longitudinally extending flange 56,58 designed to cover the upper edge of an associated sidewall 44,46. These flanges prevent the sidewalls 44,46 from coming into contact with goods lying on the grate so that wear is limited to those plate members which can be exchanged easily.

FIGS. 1 and 3 show that the frame 2 has in its end area associated with the front end 15 a bottom wall 60 covering from below the area between the sidewalls that projects outwardly beyond the grate carrier 10. The area of the frame placed onto the grate carrier 10 is open at the bottom so that gas can enter from the grate carrier into the frame element 8 and can flow to the gas-venting slots 34. The bottom wall 60 closes off the frame 2 in the area projecting outwardly beyond the grate carrier 10 in a gas tight manner in a downward direction.

The end of the frame 2 remote from the front end 15 is covered by a top wall 62. The first plate member rests against an end edge of the top wall, which edge faces the front end. The top wall is in its area facing the front end preferably profiled similar to the profile of the main section 22 of a plate member so that between the top wall and the shoulder 24 of the first plate member there is also formed a gas-venting slot.

FIGS. 1 and 2 each show a shaded area identified by the reference numeral 64 which characterizes the usual wear pattern of a frame element. From this results that it is preferably the leading areas in transporting direction that are subjected to material wear. The welding seam 42 fixing the end plate member 36 is separated in the case of the exemplary embodiment described in connection with FIGS. 1 to 5 when the wear has reached a permissible limit so that the front plate members can be removed and can be replaced with new ones. The wear on the upper edges of the sidewalls 12,14 is, for example, compensated for by building the area up through welding. It thereby helps the easy exchange of the plate members that the plate members subjected to the greatest wear are arranged in the area of the front end 15 so that they can be exchanged without disassembly of the not worn plate members.

An exchange of the plate members 52,54 is sufficient in the exemplary embodiment described in connection with FIG. 6 since the sidewalls 44,46 cannot be exposed to wear.

FIG. 1 shows schematically the arrangement of a further frame element 70 having a further row of grates, which frame element 70 is arranged in transporting direction 4 in front of the frame element 2. The row of grates is arranged offset steplike in a downward direction. The upper frame element 8 overlaps thereby the lower frame element 70 at most in the area of the top wall 62 so that the active grate surface area is not reduced. Furthermore it can be seen that the front end of all frame elements is always accessible because of the stepped arrangement so that an exchange of the most worn plate members 6 is possible without disassembling the frame elements. Also other repairs due to wear can be addressed from above, as for example building the area up through welding of the sidewalls 12,14, is possible without disassembling the frame elements.

The embodiments of the invention in which an exclusive property or privilege is claimed are defined as follows:

1. A grate element for forming a grate, comprising a frame means having two spaced-apart and elongated side members which include opposing surfaces, several plate members arranged one next to the other in a longitudinal direction of said side members, said plate members being supported on and extending transversely between said opposing surfaces of said side members, means defining a gas-venting slot between said plate members, and said plate members each being constructed as individual structural parts releasably connectable to said opposing surfaces of said side members.

2. The grate element according to claim 1, wherein said opposing surfaces of said side members each have a longitudinal guide profile extending in a longitudinal direction of said side members, and wherein each of said plate members have at their lateral edges a counter profile cooperating with an associated one of said longitudinal guide profiles.

3. The grate element according to claim 2, wherein said longitudinal guide profiles are longitudinally extending grooves and said counter profiles are tongue-like flanges conforming complementarily with respect to said longitudinal extending grooves.

4. The grate element according to claim 2, wherein said longitudinal guide profiles are tongue-like flanges and said counter profiles are grooves complementary with respect to said tongue-like flanges.

5. The grate element according to claim 2, wherein said opposing surfaces of said side members are parallel to one another and stand vertically relative to a horizontal plane containing said frame means, wherein said side members are connected at least at a front end by a front wall, an upper edge of said front wall being lower than an upper edge of said side members, and wherein said longitudinal guide profiles are oriented above said front wall on said opposing surfaces of said side members and terminate at the front end of said side members.

6. The grate element according to claim 1, wherein said plate members have at least one of leading and trailing spacing projections facing an adjacent plate member, which spacing projections are designated to abut against an adjacent plate member to define said gas-venting slot therebetween.

7. The grate element according to claim 1, wherein said plate members have on each of their lateral edges a longitudinally extending flange for covering an upper edge of an associated side member.

8. The grate element according to claim 2, wherein said plate members each have a main section forming a grate surface and a shoulder extending beneath an adjacent plate member, and wherein each of said counter profiles is provided on said lateral edges of said main section.

9. The grate element according to claim 8, wherein said longitudinally extending flanges are provided on each of said lateral edges of said main section.

10. The grate element according to claim 2, wherein an end plate member is provided which has means for facilitating a locking connection to said side members.

11. The grate element according to claim 1, wherein said frame means has a bottom wall in its end area adjacent said front end and joining said side members together thereat.

12. The grate element according to claim 11, wherein said frame means, at an end region remote from said front end, has a top wall, and wherein said top wall has at an edge facing said front end a longitudinal cross-sectional profile corresponding with a section of a plate member.

13. The grate element according to claim 1, wherein said frame means has means for facilitating a mounting thereof on a grate carrier, said grate carrier having further means for connecting further frame means to form a row of grates.

* * * * *